United States Patent [19]

Doyle

[11] Patent Number: 4,598,722

[45] Date of Patent: Jul. 8, 1986

[54] ELASTOMER HAIR ROLLER

[75] Inventor: Edward J. Doyle, Hatboro, Pa.

[73] Assignee: Conair Corporation, Edison, N.J.

[21] Appl. No.: 651,603

[22] Filed: Sep. 17, 1984

[51] Int. Cl.[4] ..... A45D 2/12

[52] U.S. Cl. ..... 132/33 R; 132/39

[58] Field of Search ..... 132/33 R, 40, 42, 39

[56] References Cited

U.S. PATENT DOCUMENTS

| | | | |
|---|---|---|---|
| 2,742,046 | 4/1956 | Jurewicz | 132/33 R |
| 2,775,244 | 12/1956 | Petitta | 132/33 R |
| 4,202,360 | 5/1980 | Walter | 132/40 |
| 4,267,851 | 5/1981 | Plaisted | 132/33 R |
| 4,453,554 | 6/1984 | Caruso | 132/40 |

*Primary Examiner*—Gregory E. McNeill

*Attorney, Agent, or Firm*—Haynes N. Johnson

[57] ABSTRACT

A hair roller is provided having a central cylindrical barrel of uniform diameter and flanged ends. The barrel is covered with a sleeve of elastomeric material. In order to fit the sleeve around the barrel, the roller structure is made of two inter-engageable, snap-fit sections. Each section has one end flange and, together, the sections form the barrel. The elastomeric sleeve is placed over the barrel and the sections are joined by snap-fit inter-engagement.

8 Claims, 11 Drawing Figures

Fig. 1.
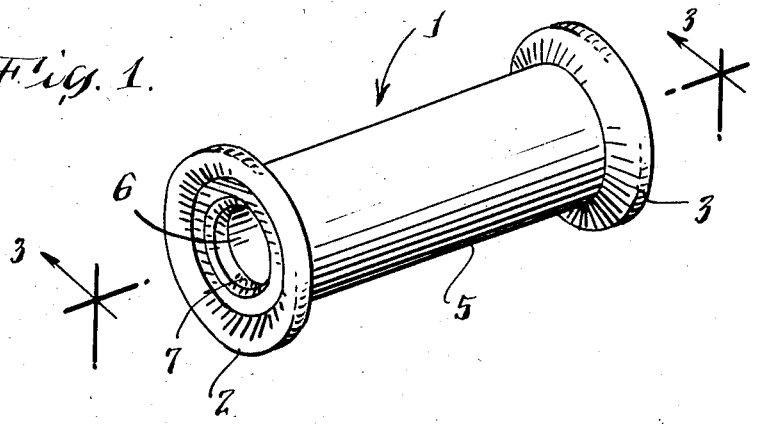
Fig. 2.
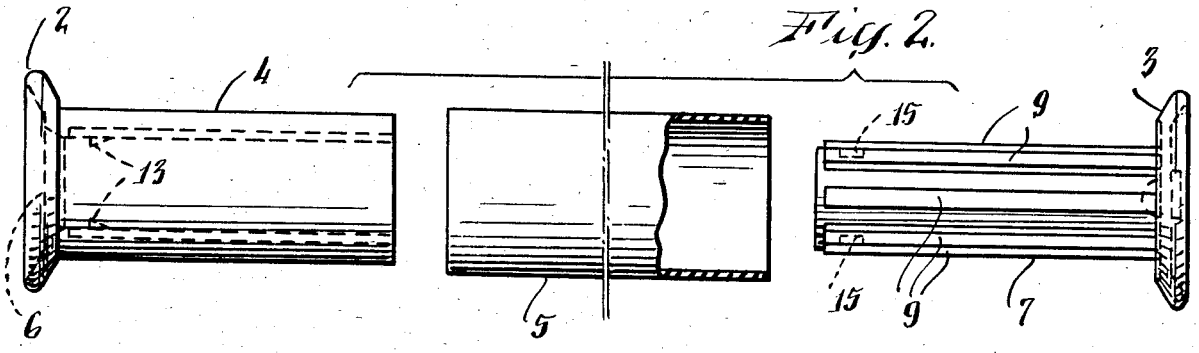
Fig. 3.
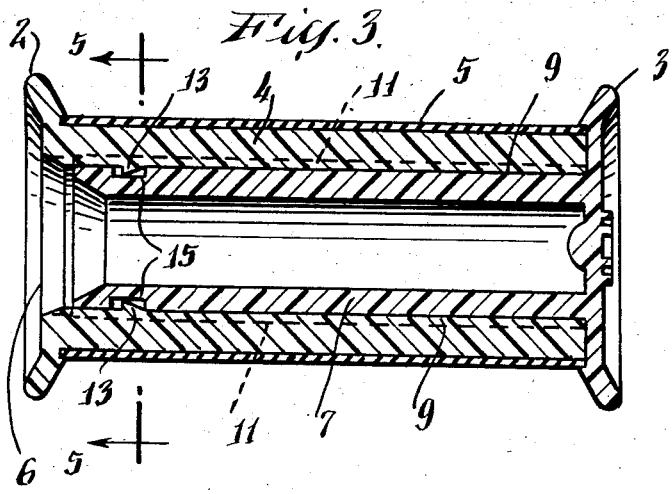
Fig. 4.
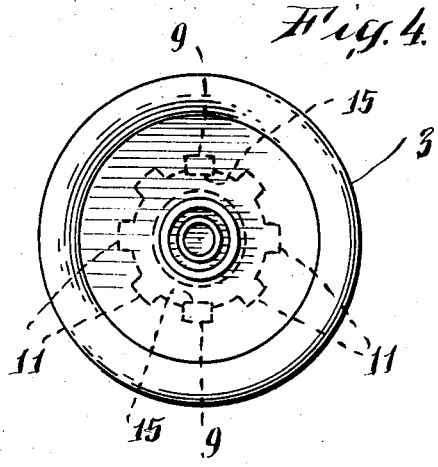
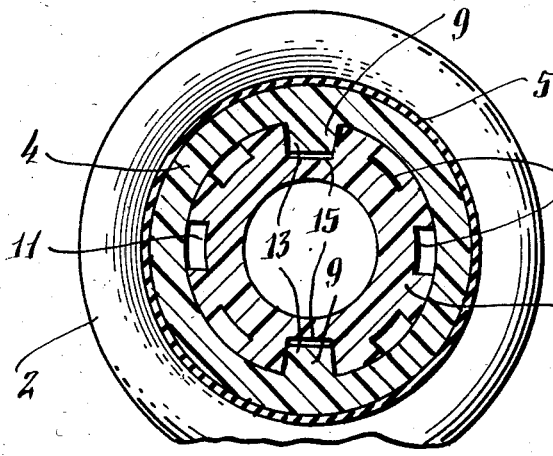
Fig. 5.

Fig. 6.
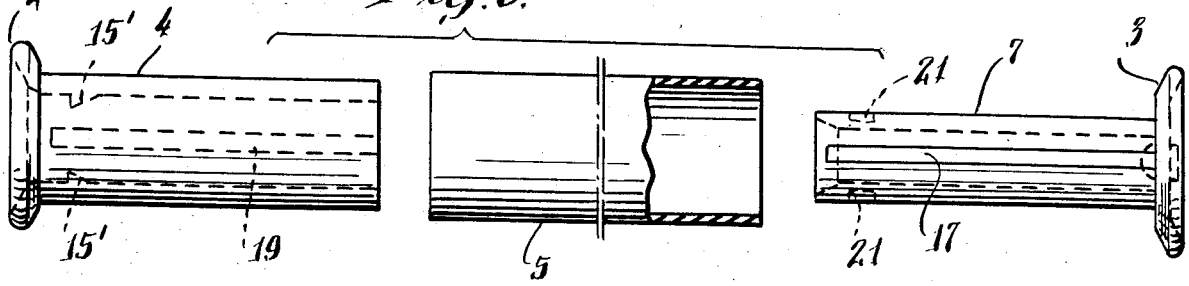
Fig. 7.
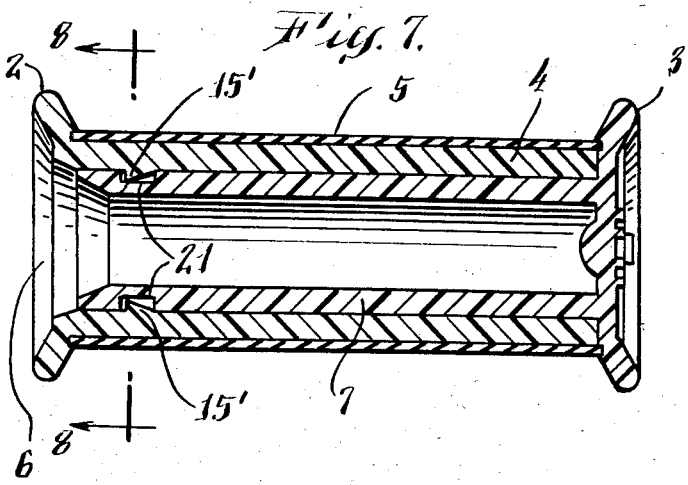
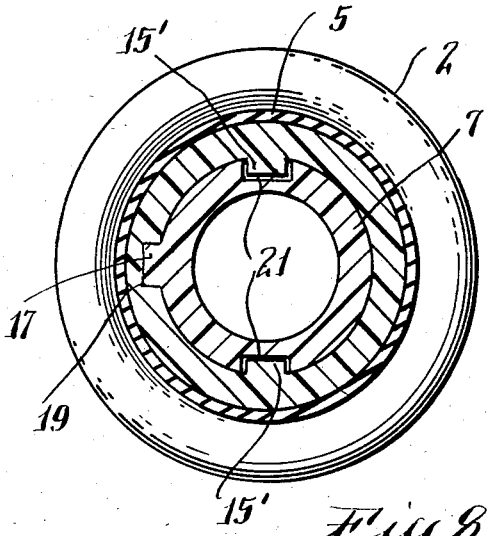
Fig. 8.
Fig. 9.
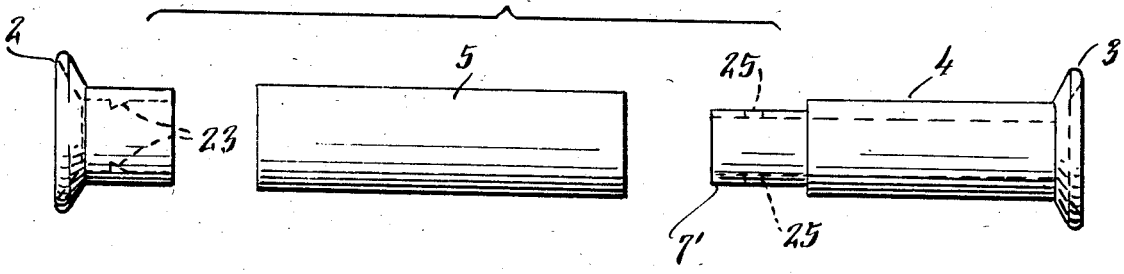
Fig. 10.
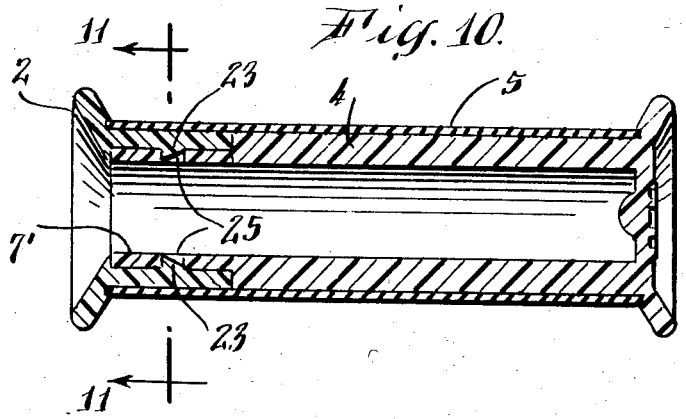
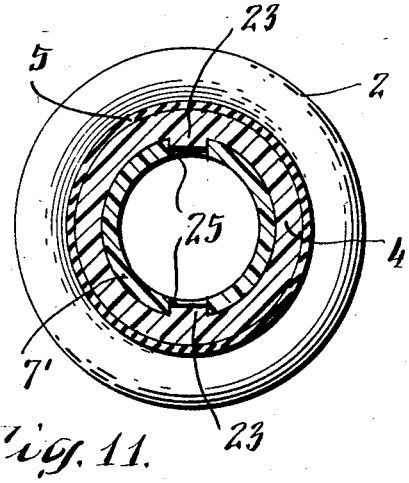
Fig. 11.

ELASTOMER HAIR ROLLER

BACKGROUND OF THE INVENTION

This invention relates to the type of hair roller which has a central cylindrical barrel section about which the hair is rolled and flanges at each end to hold the hair in place. The barrel is of uniform diameter between the flanges.

It has been found desirable to have some form of other than a smooth surface on the barrel, especially when the rollers are made of plastic. This can be done by coating the barrel with a roughened or rubber-like substance. See, for example, Cruise U.S. Pat. No. 3,316,920 and Basta U.S. Pat. No. 2,925,021. Another approach is to give the roller a flocked surface such as shown in Weldon U.S. Pat. No. 3,388,266 and Walter U.S. Pat. 4,202,360.

In providing a rubber-like or elastomeric surface, however, it is preferably to have the surface an endless band or sleeve of elastomeric material, eliminating any seam lines.

SUMMARY OF THE INVENTION

An extruded band or sleeve of rubber-like material, preferably one with an undulating or otherwise roughened surface is fitted about the cylindrical barrel of a hair roller between the end flanges.

The use of a sleeve fitting around the barrel of the hair roller creates a problem in manufacturing, however, because the sleeve will not fit over the end flanges and still fit tightly around the barrel. This problem has been solved by making the hair roller of two pieces that snap-fit together. One piece includes the barrel and one end flange, the barrel being hollow. The other piece includes the other flange and an internal barrel fitting within the first, outer barrel. The two barrel have, on their contiguous surfaces, complementary alignment and latch means so that they may be easily assembled, and, when assembled are snap-fitted together in effectively permanent interengagement.

Assembly of the hair roller involves simply placing an elastomeric sleeve about the outer surface of the barrel and then inserting the barrel until there is a locking snap fit.

Preferably, the contiguous surfaces of the two barrels also have complementary alignment means to align the latch structures. These could include, for example, one or more slots on one of the surfaces and one or more keys on the opposing surface to fit within the slots.

A modification of the above structure could also be accomplished if the outer barrel did not encompass the entire length of the barrel area and the second section formed the remaining length. Either of the two sections could then have an inner cylinder as an extension.

The inner cylinder in any of the structures should extend into the outer cylinder a sufficient length so that, when secured in position, the unit is stable and there is nominal relative movement between the flanges at the two ends.

DESCRIPTION OF THE DRAWINGS

FIG. 1 is a perspective view of the roller of my invention.

FIG. 2 is an exploded view of two roller sections and the elastomeric sleeve, showing the method of assembly of the roller.

FIG. 3 is a longitudinal section taken on line 3—3 of FIG. 1 showing an assembled roller.

FIG. 4 is an end view of the inner cylinder of FIG. 2.

FIG. 5 is a sectional view of the assembled roller taken on line 5—5 of FIG. 3.

FIG. 6 is an exploded view showing the method of assembly of a modified form of roller.

FIG. 7 is a longitudinal section of the assembled roller of FIG. 6 showing the inter-engagement of the two sections.

FIG. 8 is a section taken of line 8—8 of FIG. 7.

FIG. 9 is an exploded view of another modification of the invention in which each section includes part of the outer cylinder and the inner cylinder is of lesser length.

FIG. 10 is a longitudinal sectional view of the modification of FIG. 9.

FIG. 11 is a section taken on line 11—11 of FIG. 10.

DETAILED DESCRIPTION OF THE INVENTION

FIGS. 1 through 5 show one form of my invention, the assembled hair roller being indicated by the numeral 1. The roller includes a central clindrical barrel portion 4 with radial flanges 2 and 3 at the ends. An elastomeric sleeve 5 fits snuggly about barrel 4. It will be noted that here, as in the other modifications, that diameter of the barrel 4 and the surrounding sleeve 5 are each of uniform diameter for the entire distance between the flanges 2 and 3, permitting greater uniform area for use.

Barrel 4 and flange 2 are integrally molded of plastic material and are one piece, with barrel 4 being hollow. Flange 3 is a separate piece and is integrally molded to a generally cylindrical inner barrel 7. Barrel 7 is designed for complementary fit to the inside of outer barrel 4, with sleeve 5 surrounding and fitting tightly to barrel 4.

The respective shapes of the inner surface of outer barrel 4 and the outer surface of inner barrel 7 may vary, the important thing being that they have a complementary and stable fit and some complementary latching means between them. In the structure of FIGS. 1 through 5, inner barrel 7 includes a series of longitudinal peripheral key slots 9 on its outer surface; and the inner surface of barrel 4 includes a series of complementary inter-fitting keys 11. It would, of course, be possible to reverse these and have the slots on the inner surface of barrel 4 and the keys on the outer surface of barrel 7. With this structure, inner barrel 7 can slide within outer barrel 4 for a stable fit.

It is also important to have some form of latching means to hold the two barrels together. This is provided by having openings 13 near the ends of the key slots 9 positioned to receive extending cam latches 15 on the keys 11. There is enough play or resiliency in the interfit between the keys and key slots so that barrel 7 may be pressed inwardly to the point where the latches 15 snap into the locking openings 13 and permanently secure the two parts together.

Before joining the two barrel sections 4 and 7 with their respective flanges 2 and 3, the elastomeric sleeve 5 is slipped over outer cylindrical barrel 4. Then, when inner barrel 7 is inserted into outer cylindrical barrel 4 to the point where it snap locks into position, a completed hair roller is formed having a central barrel shaped portion with an elastomeric cover and radial flanges at each end. It should be noted that the central portion is of uniform diameter throughout its length.

FIGS. 6 through 8 show a modified structure. Here the inner barrel 7 is generally cylindrical and has a single key 17 extending into a key slot 19 on the inner surface of outer barrel 4 (see FIG. 8). Latches 15' exist as before, but for molding simplicity the locking openings (corresponding to 15 in FIG. 3) are simply transverse slots 21 from the surface of barrel 7. Once again, these parts can be reversed and interchanged, if desired.

Assembly of this modification is the same as with the first structure.

An additional modification is shown in FIGS. 9 through 11. Here the essential difference is that the inner barrel 7' is shorter and, rather than extending the full length of outer barrel 4 only extends a sufficient distance into it to provide stability. Here the latches 23 are projecting outwardly from the surface of inner barrel 7' and the latch openings 25 are recesses in the inner surface of outer barrel 4.

It should also be noted that there is a slight reversal of parts. Outer cylinder 4 has been split so that one portion is molded with flange section 2 and the other portion is molded with flange section 3; and inner barrel 7' is shorter, secured to outer barrel and is of the length just sufficient to go inside outer barrel and latch with adequate stability. In this structure keys and key slots, such as 17 and 19, are not used. Assembly is accomplished by inserting inner barrel 7' inside outer barrel its full length and then rotating the two with respect to one another until the latches snap into place.

It should be noted that each structure has an open end 6 that goes within inner cylinder 7' and, in the modification in FIGS. 9 through 11, continues through inside portion. This is to enable a heating rod to be inserted inside the length of hair roller, if desired.

The surface of the elastomeric sleeve 5 may be smooth or textured. A textured surface is often preferred since it provides a better hair-gripping surface. The texture may be simply a roughened surface, or it may be patterned with longitudinal or peripheral ripples, dimples, a plurality of small protuberances, or undulations. Preferably, the sleeve has been made by extrusion, so that its periphery is endless, i.e., without seams.

I claim:

1. A cylindrical hair roller having an elastomeric surface including a first portion having a hollow cylindrical barrel and an integral end flange, said barrel having a uniform diameter, an elastomeric sleeve of a length and diameter to fit about said barrel throughout its length, and positioned thereon, a second portion having a core dimensioned for complementary fit within said hollow barrel and a flange integral therewith, and complementary snap-fit latch means on said core and within said first portion for permanently securing together said first portion and said second portion, whereby a hair roller is provided having a uniform barrel covered with an elastomer and flanges at the ends thereof.

2. A hair roller as set forth in claim 1 in which said latch means includes at least one locking opening and at least one complementary latch, one of which is on the inner surface of said hollow barrel and the other of which is on the outer surface of said core.

3. A hair roller as set forth in claim 1 including at least one key and at least one complementary key slot, one of which is on the inner surface of said hollow barrel and the other of which is on the outer surface of said core, so positioned as to align said latching means for interengagement when said core is within said hollow barrel.

4. A hair roller as set forth in claim 1 in which said core is cylindrical and includes a cylindrical bore therein for receiving a roller heating rod.

5. A hair roller as set forth in claim 1 in which said elastomeric sleeve has a texturized surface.

6. A cylindrical hair roller having an unseamed elastomeric surface and flanged ends including a molded outer section, a complementary molded inner section, and an elastomeric sleeve, said outer section including a molded cylindrical body portion having a uniform diameter throughout its length and having a hollow longitudinal opening therein and an integral flange on one end thereof, said body portion including latching detents on its inner surface proximate to said flanged end, said inner section including a flanged end having an inner portion extending therefrom, said inner portion defining a core with a configuration having a length and diameter for complementary fit within said hollow opening, said core having snap-fit latches proximate to the ends thereof positioned for permanent engagement with said latching detents, and said elastomeric sleeve having a diameter to fit snuggly about said cylindrical body portion and a length approximating that of said body portion, said sleeve being fitted about said cylindrical body portion and said core being latched within said opening, whereby a unitary cylindrical hair curler with an elastomeric surface has been defined.

7. A hair roller as set forth in claim 6 including keying means associated with said outer section and said inner section to position said latches and said latching detents in latching alignment.

8. A hair roller having an elastomeric surface including, a first section having a cylindrical barrel portion and an integrally molded flange, a second section having a second cylindrical barrel portion of the same diameter as said first cylindrical barrel portion and an integrally molded flange, one of said sections including a core projecting axially from the end of its barrel portion and the other of said sections including an axial opening in the end of its barrel portion shaped and dimensioned to receive said core.

snap-fit latching means associated with said core and said axial openings to permanently secure said sections together when said core is within said opening, and a sleeve covering said barrel portions to provide a hair-receiving surface for said roller.

* * * * *